US011702716B2

(12) United States Patent
Ando et al.

(10) Patent No.: US 11,702,716 B2
(45) Date of Patent: Jul. 18, 2023

(54) CASE HARDENING STEEL

(71) Applicant: JFE STEEL CORPORATION, Tokyo (JP)

(72) Inventors: Keisuke Ando, Tokyo (JP); Kazuaki Fukuoka, Tokyo (JP); Kunikazu Tomita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 465 days.

(21) Appl. No.: 15/546,098

(22) PCT Filed: Jan. 25, 2016

(86) PCT No.: PCT/JP2016/000359
§ 371 (c)(1),
(2) Date: Jul. 25, 2017

(87) PCT Pub. No.: WO2016/121371
PCT Pub. Date: Aug. 4, 2016

(65) Prior Publication Data

US 2018/0030563 A1 Feb. 1, 2018

(30) Foreign Application Priority Data

Jan. 27, 2015 (JP) ..... JP2015-013686

(51) Int. Cl.
*C21D 9/32* (2006.01)
*C21D 1/28* (2006.01)
(Continued)

(52) U.S. Cl.
CPC ..... *C21D 9/32* (2013.01); *C21D 1/06* (2013.01); *C21D 1/18* (2013.01); *C21D 1/28* (2013.01);
(Continued)

(58) Field of Classification Search
CPC ..... C23C 8/22
See application file for complete search history.

(56) References Cited

U.S. PATENT DOCUMENTS 7,678,207 B2 3/2010 Omori et al.
8,673,094 B2 3/2014 Hashimura et al.
(Continued)

FOREIGN PATENT DOCUMENTS

CN 1701128 A 11/2005
CN 102131945 A 7/2011
(Continued)

OTHER PUBLICATIONS

Davis, J.R.. (2002). Surface Hardening of Steels—Understanding the Basics—1.1 Diffusion Methods of Surface Hardening. ASM International. (Year: 2002).*
(Continued)

*Primary Examiner* — Jophy S. Koshy
*Assistant Examiner* — Joshua S Carpenter
(74) *Attorney, Agent, or Firm* — Kenja IP Law PC

(57) ABSTRACT

A case hardening steel having excellent fatigue resistance is provided at relatively low production cost. A case hardening steel has a chemical composition containing C: 0.10% to 0.30%, Si: 0.10% to 1.20%, Mn: 0.30% to 1.50%, S: 0.010% to 0.030%, Cr: 0.10% to 1.00%, B: 0.0005% to 0.0050%, Sb: 0.005% to 0.020%, and N: 0.0150% or less in a predetermined range, and further containing Al: 0.010%≤Al≤0.120% in the case where B−(10.8/14)N≥0.0003%, and 27/14[N−(14/10.8)B+0.030]≤Al≤0.120% in the case where B−(10.8/14)N<0.0003%.

2 Claims, 1 Drawing Sheet

CARBURIZING PERIOD : C CONCENTRATION = 1.1%
DIFFUSION PERIOD : C CONCENTRATION = 0.8%

(51) Int. Cl.

| | |
|---|---|
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C23C 8/22*** | (2006.01) |
| ***C21D 1/06*** | (2006.01) |
| ***C22C 38/60*** | (2006.01) |

(52) U.S. Cl.

CPC ..... *C21D 6/002* (2013.01); *C21D 6/005* (2013.01); *C21D 6/008* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/32* (2013.01); *C22C 38/60* (2013.01); *C23C 8/22* (2013.01)

(56) References Cited

U.S. PATENT DOCUMENTS

| | | | | |
|---|---|---|---|---|
| 8,980,022 | B2 | 3/2015 | Miyanishi et al. | |
| 9,023,488 | B2 * | 5/2015 | Nakajima et al. | C22C 38/00 |
| 9,115,415 | B2 | 8/2015 | Okamoto et al. | |
| 10,144,196 | B2 * | 12/2018 | Nakajima et al. | B32B 15/01 |
| 2012/0018063 | A1 | 1/2012 | Hashimura et al. | |
| 2013/0122322 | A1 | 5/2013 | Nakajima et al. | |
| 2016/0151822 | A1 | 6/2016 | Nakajima et al. | |

FOREIGN PATENT DOCUMENTS

| | | | | | |
|---|---|---|---|---|---|
| CN | 102378822 | A | | 3/2012 | |
| CN | 102884212 | A | | 1/2013 | |
| CN | 103124801 | A | | 5/2013 | |
| JP | S5770261 | A | | 4/1982 | |
| JP | S58120719 | A | | 7/1983 | |
| JP | H05171262 | A | | 7/1993 | |
| JP | 2003342635 | A | | 12/2003 | |
| JP | 2004250767 | A | | 9/2004 | |
| JP | 2009108340 | A | | 5/2009 | |
| JP | 2010255066 | A | * | 11/2010 | C22C 38/00 |
| JP | 2011164768 | A | | 8/2011 | |
| JP | 2011184768 | A | | 9/2011 | |
| JP | 2012041610 | A | * | 3/2012 | C23C 2/12 |
| JP | 2012062536 | A | | 3/2012 | |
| JP | 2012140675 | A | * | 7/2012 | C22C 38/00 |
| JP | 2012140675 | A | | 7/2012 | |
| WO | 2015001705 | A1 | | 1/2015 | |

OTHER PUBLICATIONS

Google Patents English Translation of JP2012140675A retrieved Mar. 25, 2019 (Year: 2012).*

Espacenet machine translation of JP2012140675A retrieved on Dec. 12, 2022 (Year: 2012).*

Jan. 3, 2018, the Extended European Search Report issued by the European Patent Office in the corresponding European Patent Application No. 16742975.2.

Sep. 4, 2018, Office Action issued by the State Intellectual Property Office in the corresponding Chinese Patent Application No. 201680005469.1 with English language Search Report.

Apr. 12, 2016, International Search Report issued in the International Patent Application No. PCT/JP2016/000359.

Jul. 4, 2016, Office Action issued by the Taiwan Intellectual Property Office in the corresponding Taiwanese Patent Application No. 105102418, with English language Search Report.

May 9, 2017, Notification of Reasons for Refusal issued by the Japan Patent Office in the corresponding Japanese Patent Application No. 2016-528912, with English language Concise Statement of Relevance.

* cited by examiner

CARBURIZING PERIOD : C CONCENTRATION = 1.1%
DIFFUSION PERIOD : C CONCENTRATION = 0.8%

CASE HARDENING STEEL

TECHNICAL FIELD

The disclosure relates to a case hardening steel used after carburizing-quenching, and in particular to a boron-containing case hardening steel that has excellent fatigue resistance and impact resistance and can be used for drive transmission parts of vehicles and the like.

BACKGROUND

Of machine parts used in vehicles, construction machines, and other various industrial machines, parts required to have high fatigue strength and wear resistance are conventionally subjected to surface hardening heat treatment such as carburizing, nitriding, or carbonitriding. Case hardening steel such as SCr, SCM, or SNCM in JIS is typically used for these parts. The case hardening steel is formed into a desired part shape by machining such as forging or cutting, and then subjected to the aforementioned surface hardening heat treatment. After this, the case hardening steel undergoes a finishing process such as polishing, to be made into a part. With strong demand for lower manufacturing costs of parts used in vehicles, construction machines, and other industrial machines in recent years, reduction in steel material cost and streamlining and simplification of manufacturing steps are being promoted. Regarding reduction in steel material cost, various boron steels with reduced Cr or Mo content in case hardening steel are proposed.

For example, JP S57-070261 A (PTL 1) discloses a case hardening boron steel that can inhibit the coarsening of crystal grains by TiN while securing solute B, by adding Ti and fixing N in the form of TiN.

JP S58-120719 A (PTL 2) proposes an improvement in toughness in a boron steel of the same Ti-added type, by adjusting the additive amounts of Si, Mn, and Cr to reduce the abnormally carburized layer depth.

JP 2003-342635 A (PTL 3) discloses a case hardening boron steel manufacturing method that suppresses the generation of BN by the addition of a large amount of Al and prevents the abnormal grain growth of crystal grains by fine carbonitride obtained as a result of heat treatment before carburizing.

JP 2012-62536 A (PTL 4) discloses a case hardening steel with excellent cold forgeability that suppresses the formation of an abnormally carburized layer by the addition of Sb and effectively inhibits the coarsening of crystal grains by Ti—Mo-based carbide.

JP 2004-250767 A (PTL 5) discloses a steel for machine structures that reduces the decarburized layer thickness by the addition of Sb and has the same level of cold workability as conventional soft annealed steel materials, and a method of manufacturing the same.

CITATION LIST

Patent Literatures

PTL 1: JP S57-070261 A
PTL 2: JP S58-120719 A
PTL 3: JP 2003-342635 A
PTL 4: JP 2012-62536 A
PTL 5: JP 2004-250767 A

SUMMARY

Technical Problem

However, the techniques described in PTL 1 to PTL 5 have the following problems.

With the techniques described in PTL 1 and PTL 2, N is fixed in the form of TiN to prevent bonding between B and N. However, TiN exists in the steel as a relatively large square inclusion, and thus causes fatigue, resulting in surface fatigue such as pitting in a gear and lower bending fatigue strength of its gear tooth root. Square TiN also decreases the impact resistance of the gear, so that the gear may break when subjected to an impact load.

With the technique described in PTL 3, fine MN or Nb(C, N) inhibits the abnormal growth of crystal grains, thus improving impact resistance. However, deboronization occurs depending on the carburizing condition, as a result of which the surface layer part softens. This facilitates pitting on the gear tooth surface.

With the technique described in PTL 4, the addition of Sb reduces the abnormally carburized layer depth, thus improving rotating bending fatigue resistance. However, this effect of Sb may not be achieved in the case where the contents of Si, Mn, and Cr which tend to form an abnormally carburized layer are high, leading to lower fatigue strength.

With the technique described in PTL 5, reliably avoiding reduction in carbon in the surface layer is difficult depending on the balance between Sb having a decarburization suppressing effect and Si having a decarburization promoting effect, and desired properties may not be obtained.

It could therefore be helpful to provide a case hardening steel having excellent fatigue resistance at relatively low production cost.

Solution to Problem

We repeatedly conducted intensive study to develop a case hardening steel having excellent fatigue resistance and a method of manufacturing the same, from the above viewpoint. As a result, we discovered the following:

(a) AlN generated when Al fixes N is a fine precipitate, unlike a relatively large TiN inclusion generated when Ti fixes N. Accordingly, AlN does not cause a decrease in fatigue strength and toughness, and has an effect of improving fatigue strength and toughness by refining crystal grains.

(b) To secure a solute B content of 3 ppm or more which is effective for quench hardenability without adding Ti, the Al content needs to be precisely controlled based on the chemical equilibrium of Al—B—N in the steel.

(c) B undergoes changes such as oxidation, deboronization, and nitriding in the steel material surface during carburizing, due to its reactivity. This makes it difficult to ensure the quench hardenability of the surface layer part. Such reactions, however, can be suppressed by adding Sb.

(d) Si, Mn, and Cr are effective in improving temper softening resistance but, when added excessively, promote grain boundary oxidation that causes bending fatigue and fatigue cracking. Such reactions, however, can be suppressed by adding Sb depending on the contents of Si, Mn, and Cr.

The disclosure is based on the aforementioned discoveries.

In detail, we provide the following:

1. A case hardening steel comprising, in mass %, C: 0.10% to 0.30%, Si: 0.10% to 1.20%, Mn: 0.30% to 1.50%, S: 0.010% to 0.030%, Cr: 0.10% to 1.00%, B: 0.0005% to 0.0050%, Sb: 0.005% to 0.020%, N: 0.0150% or less, and Al: 0.010%≤Al≤0.120% in the case where B−(10.8/14)N≥0.0003%, and 27/14[N−(14/10.8)B+0.030]≤Al≤0.120% in the case where B−(10.8/14)N<0.0003%, with a balance being iron and incidental impurities, wherein the following relation is satisfied: Sb≥{Si/2+(Mn+Cr)/5}/70, and Ti in the incidental impurities is 0.005% or less.

2. The case hardening steel according to 1., further comprising, in mass %, at least one of Nb: 0.050% or less and V: 0.200% or less.

Advantageous Effect

It is thus possible to provide a case hardening steel that has excellent fatigue strength and is suitable for use in vehicles, industrial machines, and the like, in volume production.

DETAILED DESCRIPTION

Figure 1:
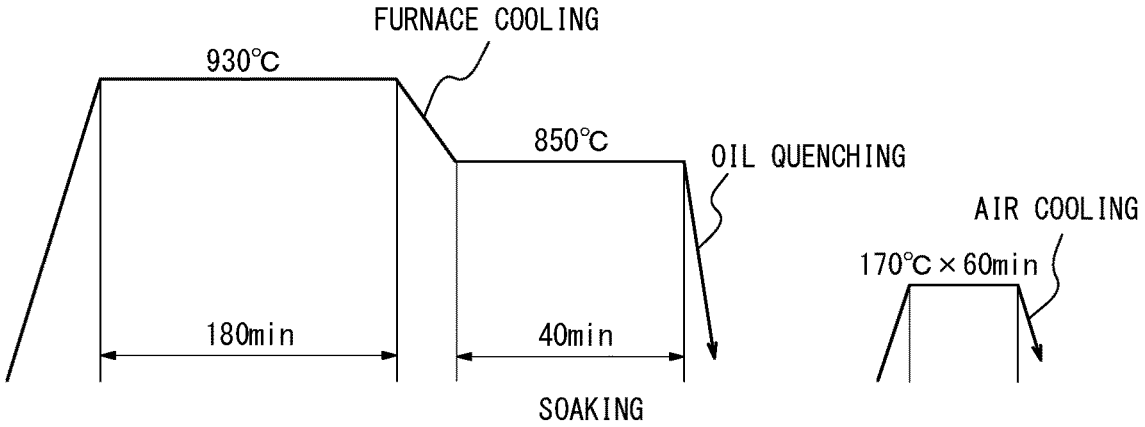
FIG. 1 is a diagram illustrating carburizing-quenching-tempering conditions.

One of the disclosed embodiments is described in detail below.

The reasons for limiting the chemical composition of the steel to the aforementioned range in this embodiment are described first. In the following description, "%" regarding components denotes mass % unless otherwise stated.

C: 0.10% to 0.30%

The C content needs to be 0.10% or more, to enhance the hardness of the center part (hereafter simply referred to as "core") of the quenched material by quenching after carburizing treatment. If the C content is more than 0.30%, the toughness of the core decreases. The C content is therefore limited to the range of 0.10% to 0.30%. The C content is preferably in the range of 0.15% to 0.25%.

Si: 0.10% to 1.20%

Si is an element effective in increasing softening resistance in the temperature range of 200° C. to 300° C. which a gear or the like is expected to reach during rolling. Si also has an effect of suppressing the generation of coarse carbide during carburizing. The Si content needs to be at least 0.10%. Meanwhile, Si is a ferrite-stabilizing element, and excessively adding Si increases the $Ac_3$ transformation point and facilitates the occurrence of ferrite in the core having low carbon content in a normal quenching temperature range, causing lower bending fatigue strength in the gear tooth root. The upper limit of the Si content is therefore 1.20%. The Si content is preferably in the range of 0.20% to 0.60%.

Mn: 0.30% to 1.50%

Mn is an element effective in improving quench hardenability. The Mn content needs to be at least 0.30%. Meanwhile, Mn tends to form an abnormally carburized layer. Besides, excessively adding Mn causes an excessive amount of retained austenite, which leads to lower hardness. The upper limit of the Mn content is therefore 1.50%. The Mn content is preferably in the range of 0.50% to 1.20%.

S: 0.010% to 0.030%

S has a function of forming sulfide with Mn to improve machinability by cutting, and so the S content is 0.010% or more. Meanwhile, excessively adding S causes lower fatigue strength and toughness of the part. The upper limit of the S content is therefore 0.030%.

Cr: 0.10% to 1.00%

Cr is an element effective in improving not only quench hardenability but also temper softening resistance. If the Cr content is less than 0.10%, the effect of adding Cr is poor. If the Cr content is more than 1.00%, an abnormally carburized layer tends to form. Besides, quench hardenability becomes excessively high, and as a result the internal toughness of the gear decreases and bending fatigue strength decreases. The Cr content is therefore limited to the range of 0.10% to 1.00%. The Cr content is preferably in the range of 0.10% to 0.60%.

B: 0.0005% to 0.0050%

B is an element effective in ensuring quench hardenability when added in a small amount, and the B content needs to be at least 0.0005%. If the B content is more than 0.0050%, the amount of BN increases, causing lower fatigue strength and toughness of the part. The B content is therefore limited to the range of 0.0005% to 0.0050%. The B content is preferably in the range of 0.0010% to 0.0040%.

Sb: 0.005% to 0.020%

Sb has strong tendency to segregate to grain boundaries, and so is an important element to suppress surface layer reactions such as deboronization and nitriding (BN formation) during carburizing treatment and ensure quench hardenability. To achieve this effect, the Sb content needs to be at least 0.005%. Excessively adding Sb, however, not only increases cost but also decreases toughness. The upper limit of the Sb content is therefore 0.020%. The Sb content is preferably in the range of 0.005% to 0.015%.

Regarding Sb, it is also important to satisfy the relationship of the following expression relating to the contents of Si, Mn, and Cr mentioned above:

$$Sb \geq \{Si/2+(Mn+Cr)/5\}/70.$$

This expression indicates a factor influencing the grain boundary oxidation layer depth. In the case where Sb does not satisfy the specified value relating to the contents of Si, Mn, and Cr, the grain boundary oxidation suppressing effect is poor, leading to a decrease in fatigue resistance.

Grain boundary oxidation is a phenomenon in which the crystal grain boundaries of the surface layer part of the steel material undergo internal oxidation in heat treatment such as carburizing treatment. If Si, Cr, or the like that is selectively oxidized easily is present in the steel, the generation of its oxide is facilitated. Since the aforementioned element is consumed by oxidation in the grain boundary oxidation part, hardness decreases with a decrease in quench hardenability in the peripheral part, which tends to cause fatigue fracture. In this embodiment, by specifying the lower limit of the additive amount of Sb having a grain boundary oxidation suppressing function depending on the contents of Si, Mn, and Cr as shown in the right side of the expression, quench hardenability in the surface layer is ensured, and a decrease in fatigue strength is prevented.

N: 0.0150% or less

N is an element that bonds with Al to form MN and contribute to finer austenite crystal grains. To achieve this effect, the N content is preferably 0.0030% or more. Excessively adding N, however, not only makes it difficult to secure solute B, but also causes blow holes in the steel ingot during solidification and decreases forgeability. The upper limit of the N content is therefore 0.0150%.

The Al content is specified as follows, depending on the amount of B. $0.010\% \leq Al \leq 0.120\%$ in the case where $B-(10.8/14)N \geq 0.0003\%$ Al is a necessary element as a deoxidizer, and is also a necessary element to secure solute B in this embodiment. Here, "B−(10.8/14)N" represents the amount of B (hereafter also referred to as "the amount of solute B") of the balance obtained by subtracting, from the B content, the amount of B that stoichiometrically bonds with N.

In the case where the amount of solute B is 0.0003% or more, solute B necessary to improve quench hardenability can be secured. In this case, if the Al content is less than 0.010%, deoxidation is insufficient, and a decrease in fatigue strength is caused by an oxide-based inclusion. If the Al content is more than 0.120%, toughness decreases due to nozzle clogging during continuous casting or the formation of an alumina cluster inclusion. Accordingly, in the case where the amount of solute B is 0.0003% or more, the Al content is set to 0.010% or more and 0.120% or less.

$27/14[N-(14/10.8)B+0.030] \leq Al \leq 0.120\%$ in the case where $B-(10.8/14)N < 0.0003\%$ In the case where the amount of solute B is less than 0.0003%, the whole amount of N bonds with B unless there is any other alloying element that easily bonds with N. This makes it difficult to secure solute B.

In this case, the amount of Al that bonds with N relatively easily needs to be increased to secure the amount of solute B contributing to improved quench hardenability. To do so, the Al content is set to $27/14[N-(14/10.8)B+0.030]$ or more, to secure the amount of solute B of 0.0003% or more. The upper limit of the Al content is 0.120%, as in the above case.

The balance other than the components described above is iron and incidental impurities. Of these impurities, Ti needs to be limited by the following upper limit.

Ti: 0.005% or less

Ti has a high strength of bonding with N, and forms TiN. TiN exists in the steel as a relatively large square inclusion, and thus causes fatigue, resulting in surface fatigue such as pitting in the gear and lower bending fatigue strength of the gear tooth root. Thus, in this embodiment, Ti is an impurity, and the Ti content is desirably as low as possible. In detail, if the Ti content is more than 0.005%, the adverse effect occurs. The Ti content is therefore limited to 0.005% or less.

The other incidental impurities include P and O.

P segregates to grain boundaries, and causes a decrease in toughness of the carburized layer and the inside. The P content is therefore desirably as low as possible. In detail, if the P content is more than 0.020%, the adverse effect occurs. The P content is therefore preferably 0.020% or less.

O is an element that exists as an oxide-based inclusion in the steel and impairs fatigue strength. O causes a decrease in fatigue strength and toughness, as with a TiN inclusion. The O content is therefore desirably as low as possible. In detail, if the O content is more than 0.0020%, the adverse effect occurs. The O content is therefore preferably 0.0020% or less.

The basic chemical composition in this embodiment has been described above. To further improve the properties, one or both of Nb and V may be added.

Nb: 0.050% or less

Nb may be added as it refines crystal grains to strengthen grain boundaries and thus contribute to improved fatigue strength. In the case of adding Nb, the Nb content is preferably 0.010% or more. The effect saturates at 0.050%. Besides, adding a large amount of Nb causes an increase in cost. The upper limit of the Nb content is therefore preferably 0.050%.

V: 0.200% or less

V is an element that improves quench hardenability and, as with Si and Cr, increases temper softening resistance. V also has an effect of inhibiting the coarsening of crystal grains by forming carbonitride. To achieve these effects, the V content is preferably 0.030% or more. The effects saturate at 0.200%. Besides, adding a large amount of V causes an increase in cost. Accordingly, in the case of adding V, the V content is preferably 0.200% or less.

To improve machinability by cutting, a free-cutting element such as Pb, Se, or Ca may be optionally added.

The manufacturing conditions when making a part for a machine structure from the case hardening steel according to this embodiment are not particularly limited, but preferable manufacturing conditions are as follows.

A steel raw material having the chemical composition described above is melted and cast into a billet. The billet is hot rolled, and then subjected to preforming for a gear. Following this, the billet is either machined or forged and then machined in gear shape, and subsequently subjected to carburizing-quenching treatment. Further, the gear tooth surface is optionally polished, to obtain a final product. Shot peening and the like may be additionally performed. The carburizing-quenching treatment is performed at a carburizing temperature of 900° C. to 1050° C. and a quenching temperature of 800° C. to 900° C. Tempering is preferably performed at a temperature of 120° C. to 250° C.

EXAMPLES

Each steel having the chemical composition shown in Table 1 was obtained by steelmaking, and cast into a billet. The billet was hot rolled to form steel bars of 20 mmφ, 32 mmφ, and 70 mmφ. Each obtained round steel bar was normalized at 925° C. In Table 1, Nos. 1 to 15 are disclosed steels having the chemical composition according to the disclosure, Nos. 16 to 33 are comparative steels containing at least one component the content of which deviates from the specified value according to the disclosure, and No. 34 is a JIS SCr420 material. An Ono-type rotating bending fatigue test piece and a gear fatigue test piece were collected from the normalized round bar. Each test piece having the chemical composition shown in Table 1 was subjected to carburizing-quenching-tempering according to the condition illustrated in FIG. 1, and then each of the grain boundary oxidation layer depth, effective hardened case depth, surface hardness, and internal hardness was investigated and a rotating bending fatigue test and a gear fatigue test were conducted. The following describes the details of each investigation.

[Grain Boundary Oxidation Layer Depth, Effective Hardened Case Depth, Surface Hardness, Internal Hardness]

The 20 mmφ, round bar of each of the disclosed steels, comparative steels, and SCr420 was subjected to carburizing-quenching-tempering treatment, and then cut. The maximum grain boundary oxidation layer depth in the cut section was measured using an optical microscope at 400 magnifications without etching.

The hardness distribution of the same section was also measured, and the depth with Vickers hardness of 550 HV from the surface was set as the effective hardened case depth. The surface hardness was defined as the mean value of 10 Vickers hardness (HV 10 kgf) points of the round bar surface. The internal hardness was defined as the mean value of 5 Vickers hardness (HV 10 kgf) points at the depth position of 5 mm from the surface layer.

[Rotating Bending Fatigue Resistance]

Figure 2:
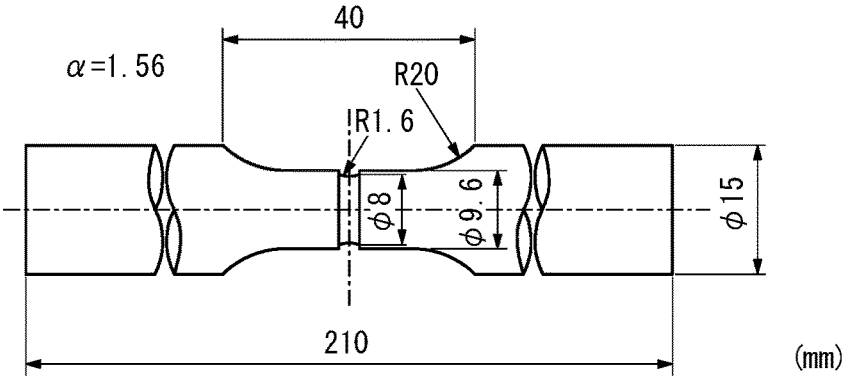
FIG. 2 is a diagram illustrating the shape of an Ono-type rotating bending fatigue test piece.

A test piece with the dimensions and shape illustrated in FIG. 2 and having a parallel portion diameter of 8 mm was collected from each round steel bar of 32 mm in diameter so that the parallel portion coincided with the rolling direction, and a rotating bending fatigue test piece was made by forming, on the whole circumference of the parallel portion, a notch (notch factor: 1.56) of 2 mm in depth in the direction orthogonal to the parallel portion. The obtained test piece was subjected to carburizing-quenching-tempering treatment. After this, a rotating bending fatigue test was conducted using an Ono-type rotating bending fatigue tester at a rotational speed of 3000 rpm, and the rotating bending fatigue strength was measured with the fatigue limit being set to $10^7$ times.

[Gear Fatigue Resistance]

Each round bar of 70 mm in diameter was hot forged and then machined to obtain a helical gear with a module of 2.5 and a pitch diameter of 80 mm. The obtained test piece was tested by a power circulation type gear fatigue tester at a rotational speed of 3000 rpm by applying a predetermined torque, using transaxle oil of 80° C. for lubrication. The gear fatigue strength was measured with the fatigue limit being set to $10^7$ times.

[Investigation Results]

Table 2 shows the investigation results of each of these investigation items. In both the rotating bending fatigue resistance and the gear fatigue resistance, the disclosed steels (Nos. 1 to 15) were at least the same levels as SCr420 (No. 34) and were better than the comparative steels (Nos. 16 to 33), as shown in Table 2.

Comparative steel No. 16 had a lower C content than the range according to the disclosure. This caused excessively low internal hardness, and resulted in a decrease in rotating bending fatigue strength and gear fatigue strength.

Comparative steel No. 17 had a higher C content than the range according to the disclosure. This caused lower toughness of the core, and resulted in a decrease in rotating bending fatigue strength and gear fatigue strength.

Comparative steel No. 18 had a lower Si content than the range according to the disclosure. This caused lower temper softening resistance, and resulted in a decrease in gear fatigue strength.

Comparative steel No. 19 had a lower Si content than the range according to the disclosure and a higher Cr content than the range according to the disclosure. This decreased the Ms point of the carburizing surface layer part, and increased the amount of retained austenite. Hence, the surface layer hardness declined, resulting in a decrease in rotating bending fatigue strength and gear fatigue strength.

Comparative steel No. 20 had a higher Si content than the range according to the disclosure. This caused the formation of ferrite inside and facilitated bending fatigue fracture in the gear tooth root, resulting in a decrease in gear fatigue strength.

Comparative steel No. 21 had a lower Mn content than the range according to the disclosure. This caused lower quench hardenability and smaller effective hardened case depth, and resulted in a decrease in rotating bending fatigue strength and gear fatigue strength.

Comparative steel No. 22 had a higher Mn content than the range according to the disclosure. This decreased the Ms point of the carburizing surface layer part, and increased the amount of retained austenite. Hence, the surface hardness declined, resulting in a decrease in rotating bending fatigue strength and gear fatigue strength.

Comparative steel No. 23 had a higher S content than the range according to the disclosure. This increased the formation of MnS causing fatigue fracture, and resulted in a decrease in rotating bending fatigue strength and gear fatigue strength.

Comparative steel No. 24 had a lower Cr content than the range according to the disclosure. This caused lower core hardness and lower temper softening resistance, and resulted in a decrease in rotating bending fatigue strength and gear fatigue strength.

Comparative steels Nos. 25 and 26 had a higher Cr content than the range according to the disclosure. This decreased the Ms point of the carburizing surface layer part, and increased the amount of retained austenite. Hence, the surface layer hardness declined, resulting in a decrease in rotating bending fatigue strength and gear fatigue strength.

Comparative steel No. 27 had a lower B content than the range according to the disclosure. This caused lower quench hardenability and smaller effective hardened case depth, and resulted in a decrease in rotating bending fatigue strength and gear fatigue strength.

Comparative steel No. 28 had a higher B content than the range according to the disclosure. This increased the formation of BN causing lower toughness, and resulted in a decrease in rotating bending fatigue strength and gear fatigue strength.

Comparative steel No. 29 had a lower Al content than the lower limit value calculated from the expression $27/14[N-(14/10.8)B+0.030]\leq Al\leq 0.120\%$) specified in the disclosure. This made it impossible to secure the amount of solute B contributing to improved quench hardenability, and caused smaller effective hardened case depth and lower internal hardness, resulting in a decrease in rotating bending fatigue strength and gear fatigue strength.

Comparative steel No. 30 had a lower Sb content than the range according to the disclosure. This caused deboronization during carburizing and decreased surface layer hardness, resulting in a decrease in rotating bending fatigue strength and gear fatigue strength.

Comparative steel No. 31 had a higher N content than the range according to the disclosure. This made it impossible to secure the amount of solute B contributing to improved quench hardenability, and caused smaller effective hardened case depth and lower internal hardness, resulting in a decrease in rotating bending fatigue strength and gear fatigue strength.

Comparative steel No. 32 had a higher Ti content than the range according to the disclosure. This facilitated fatigue fracture caused by TiN, and resulted in a decrease in rotating bending fatigue strength and gear fatigue strength.

Comparative steel No. 33 had the components in the range according to the disclosure, but its grain boundary oxidation layer was deep because the amount of Sb did not satisfy the specified expression ($Sb\geq\{Si/2+(Mn+Cr)/5\}/70$). This caused lower surface layer hardness, and resulted in a decrease in rotating bending fatigue strength and gear fatigue strength.

TABLE 1

| No. | Chemical composition (mass %) C | Si | Mn | P | S | Cr | B | Solute B *4 | Al lower limit *2 |
|---|---|---|---|---|---|---|---|---|---|
| 1 | 0.18 | 0.56 | 0.84 | 0.013 | 0.024 | 0.33 | 0.0038 | 0.0003 | 0.010 |
| 2 | 0.22 | 0.25 | 0.57 | 0.011 | 0.015 | 0.55 | 0.0029 | <0.0003 | 0.063 |
| 3 | 0.21 | 0.36 | 0.31 | 0.015 | 0.014 | 0.98 | 0.0016 | <0.0003 | 0.068 |
| 4 | 0.19 | 0.12 | 0.75 | 0.014 | 0.020 | 0.59 | 0.0036 | 0.0005 | 0.010 |
| 5 | 0.26 | 0.50 | 0.90 | 0.012 | 0.025 | 0.70 | 0.0045 | <0.0003 | 0.062 |
| 6 | 0.25 | 0.31 | 0.60 | 0.020 | 0.014 | 0.35 | 0.0020 | <0.0003 | 0.070 |
| 7 | 0.20 | 0.20 | 0.55 | 0.014 | 0.010 | 0.50 | 0.0025 | <0.0003 | 0.063 |
| 8 | 0.20 | 0.40 | 0.58 | 0.011 | 0.012 | 0.51 | 0.0007 | <0.0003 | 0.069 |
| 9 | 0.22 | 0.59 | 0.65 | 0.010 | 0.018 | 0.40 | 0.0042 | <0.0003 | 0.069 |
| 10 | 0.24 | 0.30 | 0.65 | 0.013 | 0.020 | 0.60 | 0.0035 | <0.0003 | 0.064 |
| 11 | 0.16 | 0.20 | 1.49 | 0.014 | 0.018 | 0.24 | 0.0049 | 0.0007 | 0.010 |
| 12 | 0.16 | 0.15 | 0.40 | 0.014 | 0.010 | 0.30 | 0.0010 | <0.0003 | 0.063 |
| 13 | 0.24 | 0.45 | 0.82 | 0.015 | 0.016 | 0.30 | 0.0040 | 0.0005 | 0.010 |
| 14 | 0.22 | 0.98 | 1.07 | 0.010 | 0.021 | 0.12 | 0.0031 | <0.0003 | 0.064 |
| 15 | 0.21 | 1.16 | 0.62 | 0.012 | 0.015 | 0.46 | 0.0025 | <0.0003 | 0.069 |
| 16 | 0.08 | 0.24 | 0.53 | 0.013 | 0.028 | 0.55 | 0.0018 | <0.0003 | 0.063 |
| 17 | 0.31 | 0.73 | 0.82 | 0.013 | 0.016 | 0.68 | 0.0045 | 0.0010 | 0.010 |
| 18 | 0.26 | 0.09 | 1.15 | 0.014 | 0.013 | 0.28 | 0.0026 | <0.0003 | 0.071 |
| 19 | 0.17 | 0.03 | 0.85 | 0.009 | 0.008 | 1.18 | 0.0016 | <0.0003 | 0.067 |
| 20 | 0.20 | 1.22 | 0.91 | 0.011 | 0.019 | 0.46 | 0.0034 | <0.0003 | 0.064 |
| 21 | 0.19 | 0.54 | 0.29 | 0.014 | 0.022 | 0.73 | 0.0039 | 0.0007 | 0.010 |
| 22 | 0.12 | 0.19 | 1.53 | 0.012 | 0.020 | 0.85 | 0.0020 | <0.0003 | 0.065 |
| 23 | 0.21 | 0.20 | 1.02 | 0.011 | 0.034 | 0.40 | 0.0025 | <0.0003 | 0.066 |
| 24 | 0.20 | 0.91 | 0.75 | 0.010 | 0.016 | 0.07 | 0.0014 | <0.0003 | 0.066 |
| 25 | 0.24 | 1.01 | 0.48 | 0.014 | 0.017 | 1.01 | 0.0047 | 0.0009 | 0.010 |
| 26 | 0.21 | 0.18 | 0.69 | 0.011 | 0.016 | 1.22 | 0.0023 | <0.0003 | 0.010 |
| 27 | 0.18 | 0.36 | 0.51 | 0.012 | 0.020 | 0.64 | 0.0002 | <0.0003 | 0.069 |
| 28 | 0.21 | 0.40 | 0.69 | 0.013 | 0.014 | 0.61 | 0.0052 | <0.0003 | 0.061 |
| 29 | 0.15 | 0.22 | 1.28 | 0.019 | 0.012 | 0.42 | 0.0026 | <0.0003 | 0.064 |
| 30 | 0.20 | 0.46 | 0.73 | 0.015 | 0.015 | 0.51 | 0.0029 | <0.0003 | 0.067 |
| 31 | 0.19 | 0.68 | 0.55 | 0.013 | 0.024 | 0.60 | 0.0007 | <0.0003 | 0.089 |
| 32 | 0.23 | 0.15 | 0.98 | 0.012 | 0.016 | 0.48 | 0.0021 | <0.0003 | 0.068 |
| 33 | 0.18 | 0.49 | 0.62 | 0.012 | 0.011 | 0.50 | 0.0031 | <0.0003 | 0.061 |
| 34 | 0.20 | 0.28 | 0.85 | 0.015 | 0.021 | 1.15 | — | — | — |

| No. | Chemical composition (mass %) Al | Sb | Specified expression *3 | N | Ti | O | Nb | V | Remarks |
|---|---|---|---|---|---|---|---|---|---|
| 1 | 0.013 | 0.010 | 0.007 | 0.0046 | 0.002 | 0.0013 | — | — | Disclosed steel |
| 2 | 0.075 | 0.012 | 0.005 | 0.0062 | 0.003 | 0.0012 | — | — | |
| 3 | 0.088 | 0.007 | 0.006 | 0.0075 | 0.002 | 0.0008 | — | — | |
| 4 | 0.029 | 0.008 | 0.005 | 0.0040 | 0.004 | 0.0011 | — | — | |
| 5 | 0.065 | 0.018 | 0.008 | 0.0080 | 0.001 | 0.0014 | — | — | |
| 6 | 0.090 | 0.011 | 0.005 | 0.0091 | 0.003 | 0.0010 | — | — | |
| 7 | 0.070 | 0.008 | 0.004 | 0.0060 | 0.002 | 0.0009 | — | — | |
| 8 | 0.086 | 0.010 | 0.006 | 0.0068 | 0.002 | 0.002 | — | — | |
| 9 | 0.081 | 0.016 | 0.007 | 0.0113 | 0.001 | 0.0013 | — | — | |
| 10 | 0.080 | 0.015 | 0.006 | 0.0075 | 0.003 | 0.0011 | — | — | |
| 11 | 0.030 | 0.006 | 0.006 | 0.0055 | 0.003 | 0.0008 | — | — | |
| 12 | 0.090 | 0.005 | 0.003 | 0.0039 | 0.002 | 0.0011 | — | — | |
| 13 | 0.021 | 0.015 | 0.006 | 0.0046 | 0.003 | 0.0011 | — | — | |
| 14 | 0.073 | 0.019 | 0.010 | 0.0070 | 0.002 | 0.0015 | 0.027 | — | |
| 15 | 0.118 | 0.013 | 0.011 | 0.0089 | 0.003 | 0.0012 | — | 0.058 | |
| 16 | 0.082 | 0.010 | 0.005 | 0.0050 | 0.004 | 0.0013 | — | — | Comparative steel |
| 17 | 0.025 | 0.012 | 0.010 | 0.0045 | 0.001 | 0.0014 | — | — | |
| 18 | 0.100 | 0.006 | 0.005 | 0.0102 | 0.003 | 0.0015 | — | — | |
| 19 | 0.072 | 0.012 | 0.006 | 0.0066 | 0.002 | 0.001 | — | — | |
| 20 | 0.079 | 0.018 | 0.013 | 0.0077 | 0.003 | 0.0012 | — | — | |
| 21 | 0.034 | 0.014 | 0.007 | 0.0041 | 0.002 | 0.0010 | — | — | |
| 22 | 0.085 | 0.018 | 0.008 | 0.0064 | 0.003 | 0.0011 | — | — | |
| 23 | 0.090 | 0.007 | 0.005 | 0.0073 | 0.001 | 0.0012 | — | — | |
| 24 | 0.071 | 0.009 | 0.009 | 0.0060 | 0.004 | 0.0015 | — | — | |
| 25 | 0.029 | 0.012 | 0.011 | 0.0049 | 0.005 | 0.0008 | — | — | |
| 26 | 0.062 | 0.012 | 0.007 | 0.0039 | 0.003 | 0.0009 | — | — | |
| 27 | 0.086 | 0.015 | 0.006 | 0.0058 | 0.002 | 0.0012 | — | — | |
| 28 | 0.072 | 0.010 | 0.007 | 0.0082 | 0.002 | 0.0015 | — | — | |
| 29 | 0.048 | 0.011 | 0.006 | 0.0066 | 0.003 | 0.0019 | — | — | |
| 30 | 0.099 | 0.002 | 0.007 | 0.0087 | 0.002 | 0.0013 | — | — | |
| 31 | 0.090 | 0.010 | 0.008 | 0.0172 | 0.003 | 0.0013 | — | — | |

TABLE 1-continued

| | | | | | | | | | |
|---|---|---|---|---|---|---|---|---|---|
| 32 | 0.070 | 0.019 | 0.005 | 0.0079 | 0.007 | 0.0011 | — | — | |
| 33 | 0.084 | 0.005 | 0.007 | 0.0055 | 0.003 | 0.0010 | — | — | |
| 34 | 0.032 | — | — | 0.0128 | 0.001 | 0.0009 | — | — | Conventional steel |

*1 Outside the applicable range is underlined.
*2 0.010% in the case where B − (10.8/14)N ≥ 0.0003%
27/14[(N − (14/10.8)B + 0.030] in the case where B − (10.8/14)B < 0.0003%
*3 {Si/2 + (Mn + Cr)/5}/70
*4 B − (10.8/14)N

TABLE 2

| No. | Grain boundary oxidation layer depth (μm) | Effective hardened case depth (mm) | Surface hardness (HV10 kgf) | Internal hardness (HV10 kgf) | Rotating bending fatigue strength (MPa) | Gear fatigue strength (N · m) | Remarks |
|---|---|---|---|---|---|---|---|
| 1 | 16 | 0.86 | 709 | 435 | 565 | 370 | Disclosed steel |
| 2 | 14 | 0.88 | 720 | 428 | 553 | 340 | |
| 3 | 15 | 0.90 | 725 | 431 | 555 | 360 | |
| 4 | 13 | 0.92 | 710 | 440 | 572 | 340 | |
| 5 | 17 | 0.96 | 709 | 460 | 575 | 380 | |
| 6 | 15 | 0.87 | 731 | 425 | 548 | 330 | |
| 7 | 14 | 0.85 | 725 | 428 | 561 | 340 | |
| 8 | 17 | 0.90 | 718 | 430 | 560 | 350 | |
| 9 | 15 | 0.88 | 715 | 439 | 564 | 360 | |
| 10 | 15 | 0.91 | 717 | 450 | 559 | 350 | |
| 11 | 16 | 0.93 | 702 | 453 | 568 | 370 | |
| 12 | 13 | 0.85 | 735 | 422 | 549 | 330 | |
| 13 | 14 | 0.91 | 707 | 438 | 552 | 350 | |
| 14 | 16 | 0.95 | 713 | 442 | 575 | 350 | |
| 15 | 13 | 0.96 | 722 | 449 | 581 | 380 | |
| 16 | 15 | 0.77 | 720 | 321 | 488 | 280 | Comparative steel |
| 17 | 16 | 0.95 | 705 | 486 | 524 | 300 | |
| 18 | 13 | 0.88 | 722 | 439 | 549 | 290 | |
| 19 | 15 | 0.92 | 675 | 462 | 491 | 280 | |
| 20 | 14 | 0.94 | 708 | 401 | 540 | 300 | |
| 21 | 17 | 0.81 | 711 | 375 | 500 | 290 | |
| 22 | 15 | 0.93 | 677 | 469 | 493 | 270 | |
| 23 | 15 | 0.89 | 703 | 440 | 502 | 300 | |
| 24 | 13 | 0.80 | 720 | 384 | 487 | 280 | |
| 25 | 14 | 0.94 | 681 | 465 | 499 | 270 | |
| 26 | 16 | 0.91 | 670 | 460 | 485 | 270 | |
| 27 | 17 | 0.78 | 712 | 369 | 505 | 270 | |
| 28 | 17 | 0.86 | 708 | 421 | 509 | 290 | |
| 29 | 15 | 0.75 | 689 | 372 | 493 | 260 | |
| 30 | 18 | 0.81 | 603 | 398 | 485 | 270 | |
| 31 | 17 | 0.83 | 705 | 387 | 508 | 290 | |
| 32 | 15 | 0.90 | 710 | 449 | 511 | 310 | |
| 33 | 28 | 0.83 | 620 | 438 | 480 | 270 | |
| 34 | 14 | 0.87 | 701 | 431 | 547 | 330 | Conventional steel |

The invention claimed is:

1. A steel comprising, in mass %,

C: 0.10% to 0.30%,

Si: 0.10% to 1.20%,

Mn: 0.30% to 1.50%,

S: 0.010% to 0.030%,

Cr: 0.10% to 1.00%,

B: 0.0005% to 0.0050%,

Sb: 0.005% to 0.020%,

N: 0.0089% to 0.0150%, and

Al: 0.010%≤Al≤0.120% in the case where B−(10.8/14)N≥0.0003%, and

27/14[N−(14/10.8)B+0.030]≤Al≤0.120% in the case where B−(10.8/14)N<0.0003%, with a balance being iron and incidental impurities, wherein the following relation is satisfied: Sb≥{Si/2+(Mn+Cr)/5}/70, Ti in the incidental impurities is 0.005% or less, and the steel has an effective hardened case depth of 0.85 mm or more and 0.96 mm or less, where the effective hardened case depth is defined as a depth with Vickers hardness of 550 HV from a surface of the steel.

2. The steel according to claim 1, further comprising, in mass %, at least one of Nb: 0.050% or less and V: 0.200% or less.

* * * * *